US006431038B2

(12) United States Patent
Couturier

(10) Patent No.: US 6,431,038 B2
(45) Date of Patent: Aug. 13, 2002

(54) VACUUM ASSISTED METHOD OF CUTTING A WEB MATERIAL

(75) Inventor: Dennis P. Couturier, Washburn, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 0 days.

(21) Appl. No.: 09/803,856

(22) Filed: Mar. 12, 2001

Related U.S. Application Data

(62) Division of application No. 09/353,474, filed on Jul. 13, 1999, now Pat. No. 6,296,601.

(51) Int. Cl.[7] ..... B26D 3/00

(52) U.S. Cl. ..... 83/34; 83/37; 83/305; 83/287; 493/365; 493/353; 493/361

(58) Field of Search ..... 493/365, 353, 493/356, 357, 359, 360, 361, 433, 430, 418; 83/34, 37, 305, 287, 346, 677, 698.61

(56) References Cited

U.S. PATENT DOCUMENTS 4,270,744 A * 6/1981 Trogan ..... 493/430
4,494,741 A * 1/1985 Fischer et al. ..... 493/433
4,691,908 A * 9/1987 Bradley ..... 493/361
4,762,039 A * 8/1988 Rimmele ..... 83/37
4,785,548 A * 11/1988 Saleh ..... 83/37
4,917,665 A * 4/1990 Couturier ..... 493/359
5,147,273 A * 9/1992 Rottmann et al. ..... 493/430
5,570,620 A * 11/1996 Okonski et al. ..... 83/346
5,957,821 A * 9/1999 Scharbrodt et al. ..... 83/37

* cited by examiner

*Primary Examiner*—Rinaldi I. Rada
*Assistant Examiner*—Sameh Tawfik
(74) *Attorney, Agent, or Firm*—Michael Best & Friedrich LLP

(57) ABSTRACT

An apparatus and method for distributing wear over a plurality of elements on a rotating member. In the case of a cutoff or perforation roll, a plurality of retractable cutoff or perforation blades can be actuated to be extended or retracted to selectively cut or perforate a web. To distribute blade wear, extended blades are occasionally retracted while other blades are extended. Where it is desired to continue producing cuts or perforations of a desired length through such blade indexing, the spacing and number of blades before and after indexing are preferably the same. Most preferably, each blade retracted during indexing is replaced by a blade on the same side of and at the same distance from the blade being retracted. To hold the web during web cutting or perforating operations, the roll is preferably provided with vacuum apertures to which is supplied vacuum via vacuum lines, vacuum valves, and a vacuum source, thereby creating suction through the vacuum apertures. The valves preferably have disks each with a pattern of apertures therethrough. When the disks are rotated to selected positions with respect to one another and to the roll, certain vacuum lines are opened to the vacuum source while others are closed therefrom. In this manner, vacuum can be selectively applied to only those vacuum apertures which are necessary to hold the web in place during cutting or perforating operations. By rotating the disks, the application of vacuum can be adjusted as desired (e.g., when the blades are indexed).

14 Claims, 7 Drawing Sheets

VACUUM ASSISTED METHOD OF CUTTING A WEB MATERIAL

This application is a divisional of U.S. patent application Ser. No. 09/353,474, now U.S. Pat. No. 6,296,601 filed on Jul. 13, 1999.

FIELD OF THE INVENTION

This invention relates generally to vacuum assisted rolls, and more particularly to a vacuum assisted roll apparatus and method in which a plurality of blades upon the roll are selectively actuatable to make cuts or perforations at a variety of lengths on a sheet or web of passing material, and in which vacuum is selectively ported in the roll among a plurality of vacuum ports.

BACKGROUND OF THE INVENTION

Numerous systems exist in which vacuum or forced air must be distributed to various portions of the surface of a rotating member. For example, some systems require vacuum to be selectively applied through apertures at selected circumferential locations on a rotating roll in order to hold material to the roll for a desired time or along a desired path. Other systems may require air to be forced out of similar ports to manipulate material being processed. In still other applications, the distribution of vacuum or forced air to various portions of a rotating roll is necessary to retract, extend, engage, or otherwise actuate elements or assemblies upon the roll (e.g., retractable cutoff or perforation blade assemblies, retractable anvil blade assemblies, and the like). The following discussion is with reference only to a rotating cutoff roll having alternating longitudinal rows of vacuum ports and cutoff blades for making regularly-spaced cuts in a web of material passing the roll. Vacuum supplied through the vacuum ports holds the web of material to the cutoff roll during cutting operations and until the cut material is released to downstream equipment. However, it should be noted that the following discussion applies equally to the other types of rotating members such as those mentioned above. As used herein and in the appended claims, the term "web" means any material (including without limitation paper, metal, plastic, rubber or synthetic material, fabric, etc.) which can be or is found in sheet form (including without limitation tissue, paper toweling, napkins, foils, wrapping paper, food wrap, woven and non-woven cloth or textiles, etc.). The term "web" does not indicate or imply any particular shape, size, length, width, or thickness of the material.

Conventional vacuum cutoff systems suffer from several disadvantages. First, many conventional systems typically can cut material only at set cut lengths. Therefore, to produce several different cut lengths, it is necessary to reconfigure the cutoff roll and system each time the cut length is changed. Even if such a process can be performed on the system at hand, the process is burdensome, time-consuming, and expensive, and usually cannot be performed on conventional systems without stopping the machinery, clearing product from the machinery, reconfiguring the blade arrangement, and then re-starting the machinery. Otherwise, a different system must be purchased to run the different cut lengths desired—a clearly expensive and inefficient alternative. Furthermore, these machines require a significant amount of factory floor space. In light of the above, a significant investment in worker time and machinery and/or factory floor space is often required to provide machinery capable of cutting different lengths of material.

Another disadvantage of many conventional cutoff roll systems involves the manner in which vacuum or forced air is supplied to the cutoff roll. As mentioned above, existing cutoff rolls typically have a number of blades separated by a number of vacuum apertures between the blades. Regardless of the number and spacing of the blades upon the cutoff roll, vacuum supplied to the apertures therefore is sufficient to hold web material to the surface of the cutoff roll before, during, and/or after web cutting operations. Unfortunately however, such cutoff rolls require relatively large vacuum systems due to the large number of vacuum apertures. If a smaller vacuum system is desired, selected vacuum apertures need to be taped or otherwise covered or shut. Covering or shutting vacuum apertures is a tedious, time-consuming, and expensive process typically requiring system shutdown.

Furthermore, many cutoff roll systems repeatedly use a first cutoff blade located at, for example, a zero degrees position on the cutoff roll, along with a number of other blades located at specific cut lengths and corresponding angular positions from the first blade. The first blade is typically used in all cuts, while the other blades in the system are used periodically, depending upon the cut length. Thus, the first blade is subject to significantly more wear than the other blades in the system and requires frequent maintenance and/or replacement.

Conventional cutoff roll systems have minimal to no ability to easily control which vacuum holes on the cutoff roll are covered or shut and which are open, and which blades on the cutoff roll are extended and which are retracted. Even where such control does exist, conventional system users do not have the ability to quickly and easily select one of a number of extended cutoff blade patterns and one of a number of open vacuum aperture patterns. Therefore, conventional systems are largely unable to prevent excessive blade wear and/or to provide a large amount of web control without a using a relatively large vacuum system.

In light of the problems and limitations of the prior art described above, a need exists for a cutoff roll which can produce cut lengths of web material while avoiding uneven wear distribution between the various blades on the cutoff roll, which can be quickly and easily controlled to change the locations of extended blades and to open vacuum apertures on the cutoff roll without requiring significant machine downtime and manual changes to the system, which provides superior control of vacuum apertures and extended blade positions, and which requires a relatively small vacuum system to operate. Each preferred embodiment of the present invention achieves one or more of these results.

SUMMARY OF THE INVENTION

The invention provides a vacuum assisted cutoff roll in which the blades upon the roll can be selectively controlled to provide a variety of cut lengths in a web of material and to prevent excessive blade wear upon any particular blade upon the roll. Preferably, vacuum apertures between the blades can also be selectively controlled to retain the web being cut to the roll before, during and/or after the web is cut. The vacuum apertures preferably form longitudinal rows alone the cutoff roll, at least one row being spaced between equally-spaced blades around the circumference of the cutoff roll.

The individual blades upon the cutoff roll can be actuated to provide for various actuated blade combinations on the cutoff roll. Preferably, the actuated blades in each of these actuated blade combinations are spaced equally from one another to produce equally-spaced cuts in the web. To prevent excessive wear of any particular blade or blades on the cutoff roll, blades are occasionally or periodically indexed such that when the blades in a configuration are retracted, another set of blades are extended which are each preferably located on the same side and substantially the same circumferential distance away from the retracted blades. In this manner, the retracted set of blades and the extended set of blades both have the same configuration and spacing to produce the same spaced cuts in the web of material passing the cutoff roll. Also, no one blade is exposed to excessive wear by being continuously used after the blades have been indexed.

To increase system efficiency, vacuum is preferably selectively supplied only to those vacuum apertures in which vacuum is needed to hold the web to the cutoff roll surface. Preferably, the cutoff roll is connected to a vacuum source or vacuum generator via a vacuum valve having a plurality of disks. The discs preferably have a plurality of apertures therethrough which, when correctly positioned, bring selected rows of vacuum apertures on the cutoff roll into fluid communication with the vacuum source or vacuum generator to exert suction force through the selected rows. The discs can be positioned in a number of ways with respect to one another (and with respect to the cutoff roll) in order to provide vacuum only to those apertures in which vacuum is required and to block vacuum from those apertures in which vacuum is not required. By providing vacuum only where it is required, the size of the required vacuum source or generator is reduced as compared to a system which maintains vacuum across most or all of the roll, regardless of the position of the cutting blades.

More information and a better understanding of the present invention can be achieved by reference to the following drawings and detailed description.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
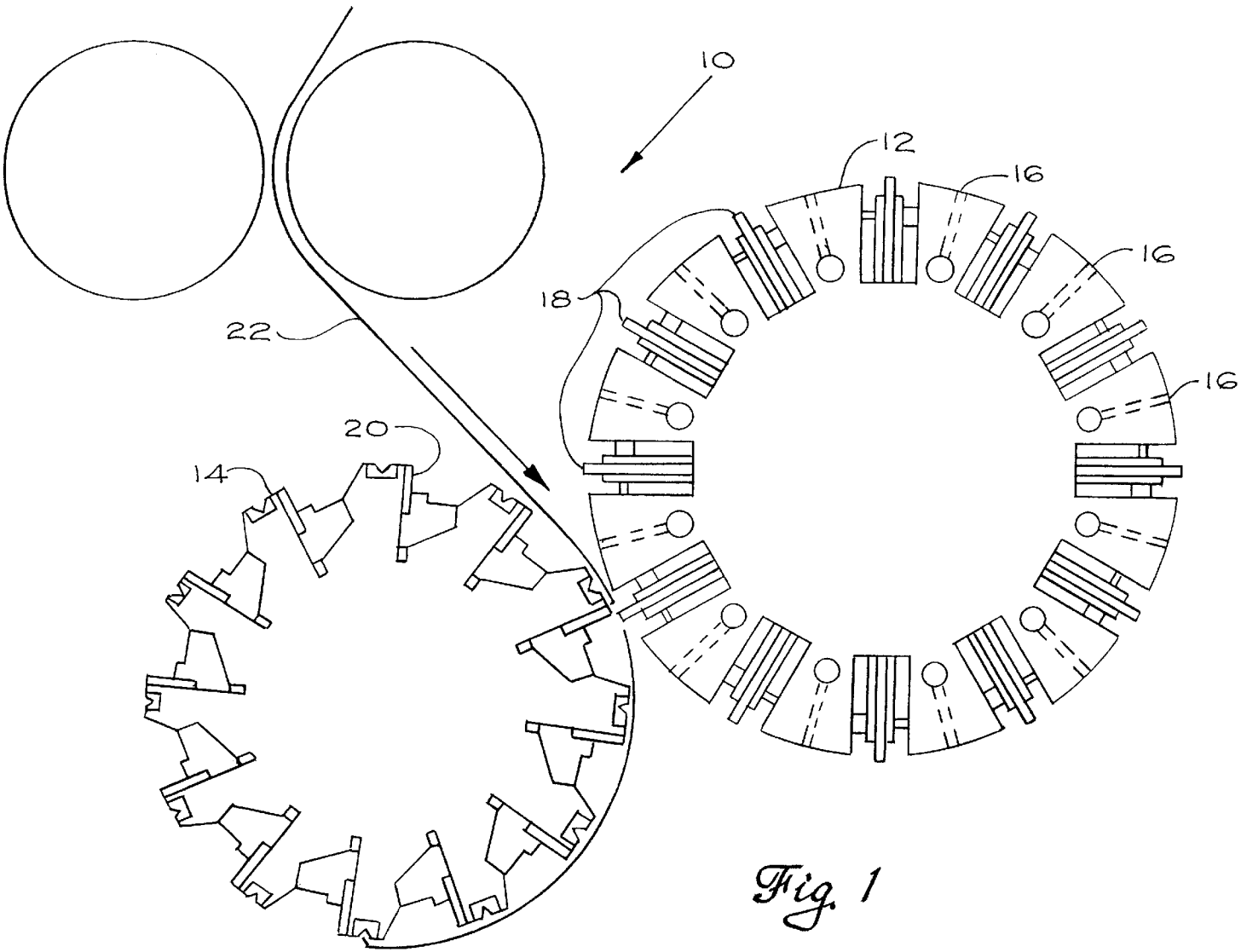
FIG. 1 is an elevational side view of a vacuum assisted cutoff roll system constructed in accordance with a preferred embodiment of the present invention.

Referring to the drawings and more particularly to FIG. 1, a cutoff roll system 10 is illustrated which employs a preferred embodiment of the present invention. However, as noted above, the present invention can be applied in many other applications to achieve similar advantages, such as for perforation, embossing, folding, or other types of rolls, for forced air systems in rolls (rather than vacuum systems in rolls), and for controlling actuation of blades, bars, inking or gluing devices, or virtually any other type of element or apparatus on a roll which is to be selectively operated or actuated. Such conventional elements and apparatuses can be actuated directly by fluid or gas pressure or vacuum, or in conjunction with well-known electrical and/or mechanical systems or devices. In the latter case, conventional mechanical systems and devices can be used which are responsive to fluid or gas pressure or flow, or to the exposure or removal of vacuum. For example, retractable blades 18 upon the cutoff roll 12 can be actuated directly by air, fluid, or vacuum pressure, or can be moved by one or more bladders which underlie the blades 18 and which themselves are responsive to such pressure by extending or retracting the blades 18. As used herein and in the appended claims, the terms "cut", "cutting" and "cutoff" encompass without limitation a cut, perforation, tear, rupture or break in the web 22, regardless of shape, size or continuity of the cut, perforation, tear, rupture or break.

The cutoff roll system 10 illustrated in the figures preferably comprises a vacuum assisted cutoff roll 12 and a cutoff bedroll 14. The cutoff roll 12 includes a plurality of vacuum apertures 16 and a plurality of selectively actuatable blades 18. Each blade 18 is preferably actuatable between a retracted position in which the blade does not cut a passing web 22 and an extended position in which the blade can cut the passing web 22. As indicated above, numerous conventional systems and devices exist for controlling the actuation of retractable blades. For example, the blades can be controlled by pressurized air or fluid (such as by the same vacuum system described below and used for holding the web 22 against the surface of the cutoff roll 12), by electromechanical systems employing solenoids, electromagnets and the like, by mechanical devices employing hydraulic or air-actuated bladders, by direct air or fluid pressure devices, etc. Such retractable blades and actuators are well known to those skilled in the art and are therefore not described further herein.

The cutoff bedroll 14 preferably includes a plurality of anvils 20 such that, as the cutoff roll 12 rotates, the web 22 is periodically cut between the actuated blades 18 upon the cutoff roll 12 and the anvils 20 upon the cutoff bedroll 14. Cutoff bedrolls and anvils 20 are well known to those skilled in the art and are not therefore described further herein.

Figure 2:
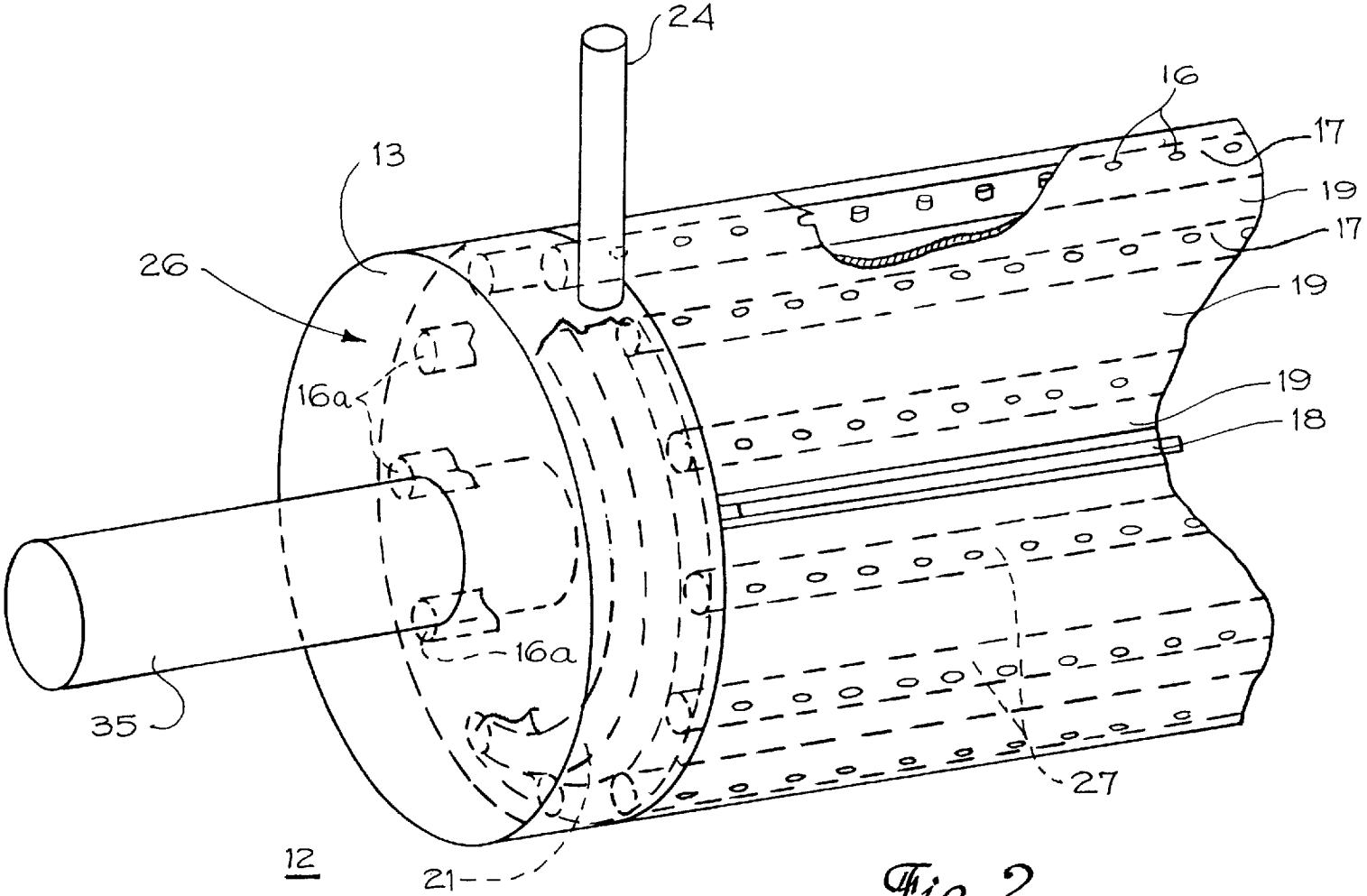
FIG. 2 is a perspective view of the vacuum assisted cutoff roll shown in FIG. 1, illustrating vacuum connections to the cutoff roll.

Referring also to FIG. 2, the vacuum apertures 16 are preferably arranged in a plurality of rows 17 running longitudinally along the cutoff roll 12. Blades 18 are mounted in blade receiving regions 19 located between rows 17 of the vacuum apertures 16 (only one blade 18 being shown in FIG. 2). The vacuum apertures 16 are conventional and can be arranged in a large number of ways. Although preferably the vacuum apertures 16 are arranged in rows which alternate with cutoff blades 18 on the cutoff roll 12, the apertures 16 can be in multiple rows between the cutoff blades 18, can be patterned in a grid or screen form between cutoff blades 18, and can be in the form of round holes, slots or any other aperture shapes between the cutoff blades 18.

Further details of one vacuum assisted cutoff roll 12 used in one preferred embodiment of the present invention are shown in FIG. 2. Vacuum assisted cutoff rolls of this type are well known in the art as disclosed in U.S. Pat. No. 4,494,741 issued to Fischer et al. Vacuum (from one or more vacuum generators or a vacuum source) is preferably supplied to a valve 26 located at the end of the cutoff roll 12, and more preferably to valves 26 located on both ends 13 of the cutoff roll 12. More specifically, each valve 26 preferably has a vacuum inlet 24 maintaining fluid communication between the valves 26 and the vacuum generators or vacuum source. Each of the valves 26 can be fixed to a support frame (not shown) for the cutoff roll 12 by spring loaded studs in the manner disclosed in the Fischer Patent. The valves 26 distribute vacuum to vacuum lines 27 running within the cutoff roll 12, and thereby to the vacuum apertures 16 in the cutoff roll 12. The term "lines" as used herein refers to a structure linking the valves 26 to the vacuum apertures 16 in the cutoff roll 12, and does not indicate or imply any particular shape or size of the structure. The lines 27 can be virtually any shape and size capable of establishing fluid communication between the valves 26 and the vacuum apertures 16, and can extend in virtually any manner within the cutoff roll 12 to do so. Preferably however, the vacuum lines 27 have a round cross-sectional shape, are straight, and extend longitudinally from the ends 13 of the cutoff roll 12 beneath and to each vacuum aperture 16 in a row of vacuum apertures 16 as best shown in FIG. 2.

Preferably, vacuum is selectively supplied to the vacuum apertures 16 through a manifold arrangement similar to the manner described in the Fischer Patent, hereby incorporated by reference insofar as it relates to the vacuum manifold system and cutoff system disclosed therein. Each vacuum valve 26 preferably defines a vacuum chamber 21, shown partially broken away in FIG. 2. The vacuum chamber 21 is generally annular in shape in order to minimize the amount of vacuum necessary for operation of the present invention. However, if desired, the vacuum chamber 21 in each vacuum valve 26 can take any shape capable of maintaining fluid communication through the vacuum valve 26 to each of the vacuum lines 27. Preferably, equally spaced inlets 16*a* in the ends 13 of the cutoff roll 12 connect the vacuum chambers 21 to each of the vacuum lines 27.

Figure 3:
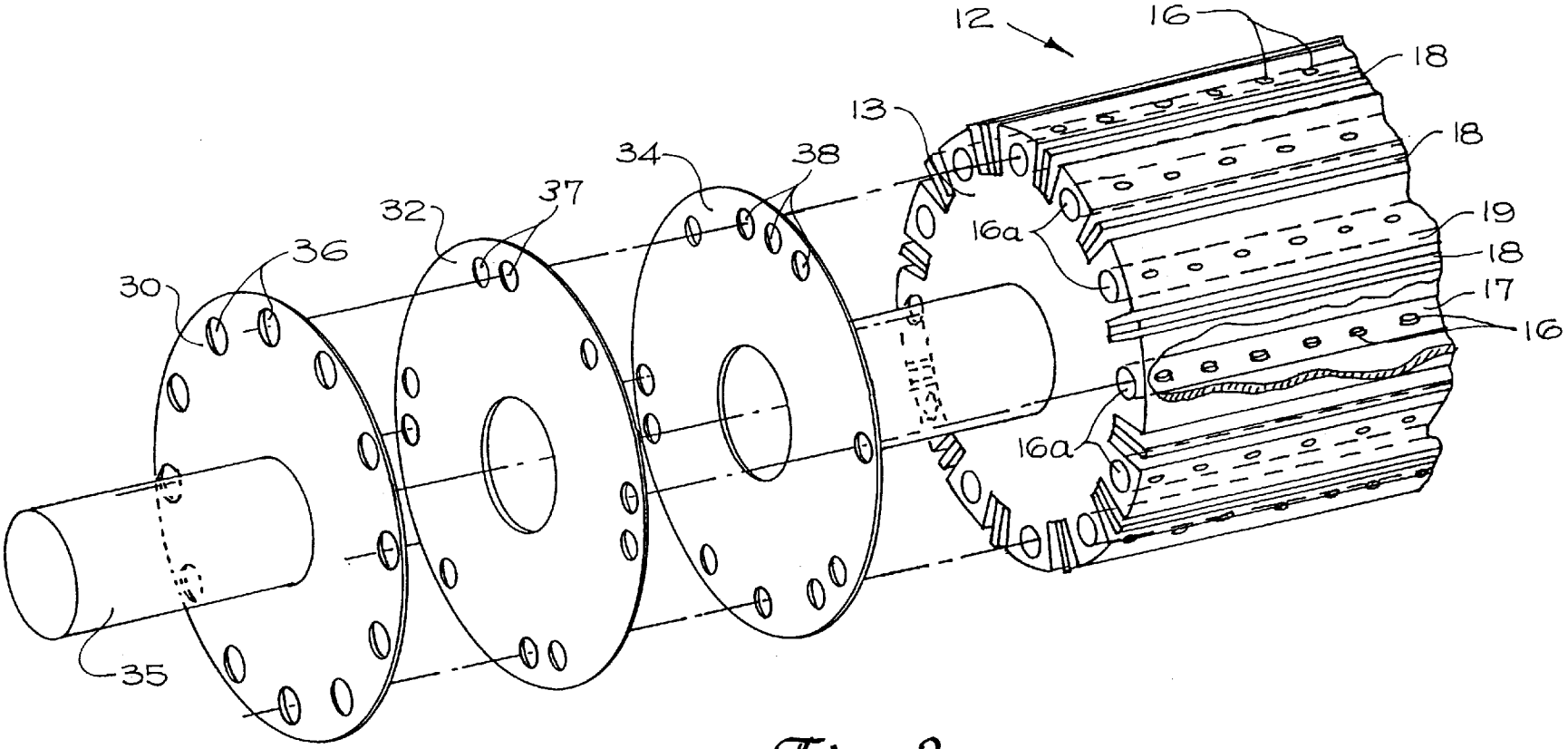
FIG. 3 is an exploded perspective view of the vacuum assisted cutoff roll shown in FIGS. 1 and 2, illustrating the disks of the vacuum valve.

The vacuum valve 26 further includes a set of disks 30, 32 and 34 (see FIG. 3) which provide a manifold allowing controlled and selective supply of the vacuum to the vacuum inlets 16*a,* vacuum lines 27, and vacuum apertures 16 as will be discussed below. The disks 30, 32 and 34 are preferably located within the vacuum valves 26 adjacent to the ends 13 of the cutoff roll 12 as shown in FIG. 3, with disk 34 positioned adjacent to the end 13 of the cutoff roll 12 and disk 32 located between disk 30 and disk 34. The disks 30, 32, 34 are each preferably flat, round, plate-shaped elements secured to the ends 13 of the cutoff roll 12. However, the disks 30, 32, 34 can instead be any shape and thickness desired, and need not resemble a disk at all. Although disks having other shapes and dimensions may be heavier or more difficult to balance than the preferred round, flat, plate-shaped disks illustrated, such other disks are equally capable of covering or uncovering selected inlets 16*a* and vacuum lines 27 via a number of disk apertures (in the manner discussed below) to accomplish the functions of the present invention. These other disk types therefore fall within the spirit and scope of the present invention.

Disks 30, 32, 34 are each preferably secured in a conventional manner to the end 13 of the cutoff roll 12 for rotation therewith. However, disks 32 and 34 can preferably be rotated to change the angular relationship of disks 32 and 34 with respect to disk 30, which is preferably fixed for rotation with cutoff roll 12. Most preferably therefore, disks 30, 32, 34 are conventionally mounted upon shafts 35 extending from the ends 13 of the cutoff roll 12. To permit adjust of the angular relationship of disks 32 and 34 with respect to disk 30 and to prevent accidental adjustment of the disks, elastomeric gaskets (not shown) can be sandwiched between the disks to provide frictional resistance to turning of the disks 32, 34 by rotational forces generated during normal system operation. Alternatively, the disks 32, 34 can be releasably fastened to the shaft 35, to the fixed disk 30, and/or to the end 13 of the cutoff roll 12 by any conventional releasable fastener. For example, setscrews, bolts, or other fasteners can be passed axially through the disks 32, 34 into the fixed disk 30 and/or the end 13 of the cutoff roll 12 (or vice versa), and can be loosened to permit rotational adjustment of either disk 32, 34 and then tightened to secure the relative positions of the disks 30, 32, 34. Other conventional releasable fasteners include spring detents located between the disks 32, 34 and the fixed disk 30 and/or the end 13 of the cutoff roll 12, clips securing the disks 32, 34 to the fixed disk 30 and/or the end 13 of the cutoff roll 12, etc.

Alternatively, the disks 32, 34 can be keyed or mounted in any well known fashion to conventional bushings which themselves can be loosened and tightened to adjust the rotational angle of the disks 32, 34. Even more advanced forms of releasable securement methods are possible, such as by electromagnets located upon or embedded within the disks 30, 32, 34, and/or the end 13 of the cutoff roll 12 and controllable manually or via a conventional controller to release the disks 32, 34 for angular adjustment. The disks 32, 34 can even be separately controlled for rotation by one or more motors moving the disks in a conventional manner (e.g., by two or more telescoping shafts each secured to one of the two disks 32, 34 and each separately powered by a different motor, one or more powered gear assemblies meshing with gear teeth on the edges of the disks 32, 34 to rotate the disks 32, 34 with the cutoff roll 12, etc.). In each of the embodiments just described, the disks 30, 32, 34 are normally secured for rotation with the cutoff roll 12, but disks 32, 34 are adjustable manually or automatically to change their angular orientation with respect to the fixed disk 30. Where adjustment is performed automatically, such adjustment can be performed via one or more control devices such as a programmable logic controller, a computer, a microcontroller interface, and the like. Like the various conventional manners of adjustably mounting the disks 32, 34 in the valves 26, these different manners of adjustment fall within the spirit and scope of the present invention.

The fixed disk 30 preferably includes a number of apertures 36 numbered, arranged, and spaced to match the inlets 16*a* in the end 13 of cutoff roll 12, thereby permitting vacuum to communicate between the vacuum valve 26 and the vacuum ports 16. The rotationally adjustable disks 32 and 34 also include apertures 37 and 38, one or more of which can be aligned with apertures 36 in the fixed disk 30 and the inlets 16*a* in the end 13 of the cutoff roll 12 in a number of different angular positions of the disks 32, 34. The disks 32, 34 preferably have fewer apertures 37, 38 than the fixed disk 30. However, disks 32, 34 having more apertures 37, 38 work well provided that when apertures in the disks 32, 34 are to be blocked in various predefined positions of the disks (described in more detail below), such apertures 32, 34 are fully blocked to close fluid communication through such apertures 32, 34.

The disks 32, 34 are spaced such that, when the disks 32, 34 are rotated to predefined positions relative to one another, to the fixed disk 30, and to the cutoff roll 12, the disks 32, 34 selectively prevent vacuum from being extended from the vacuum valve 26 to the vacuum inlets 16*a*, vacuum lines 27, and vacuum ports 16 corresponding to those vacuum lines 27. The disks 32 and 34 thereby selectively connect and disconnect the vacuum ports 16 to the vacuum source or vacuum generator (not shown). Through proper alignment of the disks 30, 32, 34, the rotatable disks 32 and 34 can therefore provide a number of different activation configurations for the vacuum lines 27 and vacuum ports 16 in the cutoff roll 12. It should be noted that the terms "align", "aligned", and "alignment" used herein and in the appended claims do not mean that one or more apertures in the disks are exactly aligned with one another or share a common central axis. These terms mean apertures are at least placed so that gas or fluid is not fully blocked from passing through both apertures, or in other words that some degree of fluid communication is established through the subject apertures.

As is indicated above, the cutoff roll 12 includes a plurality of blades, each disposed in a mounting region 19 preferably located between rows of vacuum apertures 16. The blades 18 are mounted in the cutoff roll 12 as required by the selected cut lengths, and are held in position upon the cutoff roll 12 in a conventional manner, such as by spring clips or other known devices. Actuation (e.g., extension or retraction) of the blades 18 is performed in a manner discussed above, and can be controlled either manually or automatically in ways well known to those skilled in the art, such as by a programmable logic controller, a computer, a microcontroller interface, and the like. It should be noted that manual actuation of the blades 18 can be performed by physically removing a blade 18 from the cutoff roll 12 and securing a blade 18 to the cutoff roll 12. Therefore, the terms "actuated", "retracted" and "extended" as used herein and in the appended claims encompass the acts of removing and adding blades 18 to the cutoff roll 12.

Preferably, vacuum is selectively applied to the vacuum apertures 16 in a manner discussed below such that one row of vacuum apertures 16 is activated between adjacent pairs of selected blades 18. The activated vacuum apertures 16 therefore maintain cut portions of the web upon the cutoff roll 12 until the cut portions are passed to downstream equipment and/or operations.

To equalize wear among the plurality of blades 18, the blades 18 can be periodically or occasionally indexed. In other words, blades 18 which have been actuated to their extended cutting positions for a period of time can be retracted and other blades in their retracted positions can be extended to continue cutting operations on the passing web 22. In order to continue the same type of cutting operations (i.e., to keep the same spacing between cuts on the web 22), the blades 18 being extended should be spaced apart and arranged upon the cutoff roll 12 in the same manner as the blades 18 being retracted. Of course, if a new cut length is to be made in the passing web 22, the blades 18 being extended will be spaced or numbered and spaced differently than those being retracted. In any case, preferably none of the blades 18 that have just been used and are being retracted are the same as those being extended, thereby avoiding excessive wear on any one blade.

Figure 4:
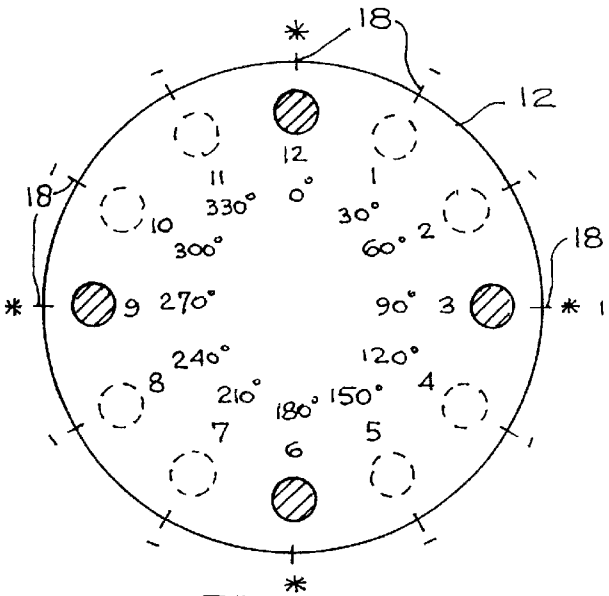

In those cases where the cut length in the passing web 22 is to be kept constant, each blade 18 being extended is preferably located the same distance and angular direction from a respective blade 18 being retracted. Repeated blade indexing in this manner therefore more evenly distributes wear across all of the blades 18. An example of this type of blade indexing is described with reference to FIG. 4. In a preferred embodiment of the present invention, there are an even number (twelve) of blades 18 on the cutoff roll 12, spaced equidistantly around the circumference of the cutoff roll 12. To index the blades 18, each blade 18 currently in its cutting position is actuated to its retracted position and a blade 18 in each adjacent mounting region 19 is actuated to its extended position to replace the blade 18 being retracted. With reference to FIG. 4, extended blades 18 in positions 12, 3, 6, and 9 are retracted, while retracted blades 18 in positions 1, 4, 7, and 10 are extended. Because the blades 18 are equally spaced, the cut length in the passing web 22 will remain the same as the blades 18 are indexed around the circumferences of the cutoff roll 12 in this manner. Also, because none of the blades 18 being retracted are the same as those being extended, excessive blade wear on any particular blade is avoided. In another index of the blades 18, preferably blades 18 in positions 1, 4, 7, and 10 are retracted, while retracted blades 2, 5, 8, and 11 are extended.

Figure 6:
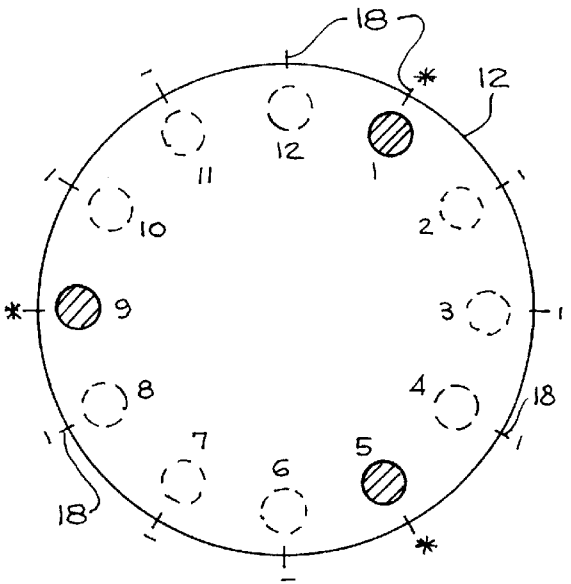
FIGS. 4–6 are elevational side views of the cutoff roll of FIGS. 1–3, illustrating a method of indexing the blades on the cutoff roll.
Figure 5:
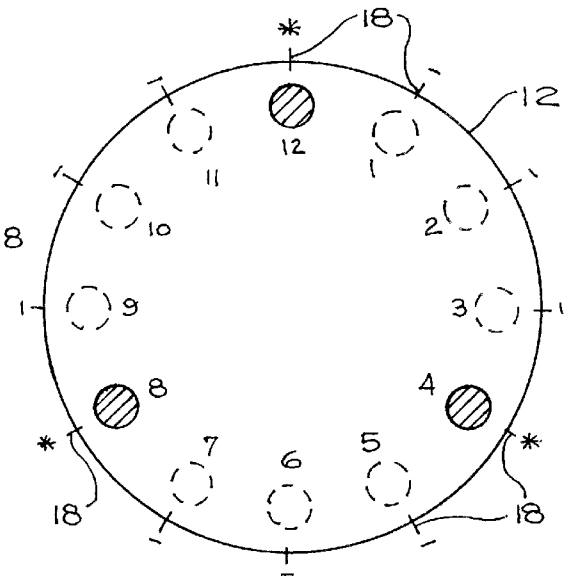

FIGS. 4–6 illustrate another form of blade indexing, in which the cut length in the passing web 22 is changed. By way of illustration, the cutoff roll 12 includes twelve blades 18 with adjacent blades 18 being separated from each other by a distance equal to thirty degrees of the circumference of the cutoff roll 12. To make four equal cuts in the passing web 22 for each revolution of the cutoff roll 12, four of the blades 18 located at four equally spaced circumferential positions on the cutoff roll 12 are in their extended cutting positions. This extended blade arrangement is shown in FIG. 4, with extended blades being marked by an asterisk (*) located for example at the 0 degree or 12 o'clock position, the 90 degrees or 3 o'clock position, the 180 degrees or six o'clock position, and the 270 decrees or 9 o'clock position. In conventional systems, when the cut length is changed from four equal cuts to three equal cuts in a single revolution of the cutoff roll 12, the blades 18 at the 0, 120, and 240 degrees positions would be extended as indicated by asterisks (*) in FIG. 5. Therefore, the blade 18 at the 0 degree circumferential position would be employed to make cuts in both cases: where three equal cuts in the web 22 are desired and where four equal cuts in the web 22 are desired. Accordingly, the blade 18 at the 0 degree circumferential position would be subject to significantly more wear than other blades 18 in the system 10, and would require more frequent maintenance and replacement than the other blades.

Even though the problem with repeated use of the blade 18 at the 0 degree circumferential position in FIG. 4 can be mitigated by indexing through the blades as shown in FIG. 6 (where blades 18 are instead extended at the 30 degrees or 1 o'clock position, the 150 degrees or 5 o'clock position and the 270 degrees or 9 o'clock position), the blade at the 9 o'clock position still performs cuts both in the three and four cut configurations. In fact, careful review of FIGS. 4–6 will show that no 3 equally-spaced blade configurations exist on the cutoff roll 12 which do not have a blade 18 also used in the 4 equally-spaced blade configuration. However, after a period of blade use in the three-cut configuration shown in FIG. 5 for example, the blades 18 can be indexed to the three-cut configuration shown in FIG. 6. After another period of blade use in the FIG. 6 configuration, similar indexing can be performed to a three-cut configuration with blades cutting at the 2, 6, and 10 o'clock positions for a period of time, followed by indexing to blades at the 3, 7, and 11 o'clock positions for a period of time, and then followed by indexing back to the configuration illustrated in FIG. 5. Therefore, even though changing blade configuration from one length of cut to another length of cut can require multiple uses of the same blade or blades 18 in both cut lengths, continued indexing such as that just described in the present invention will minimize excessive wear on any one blade 18.

As just discussed, blade indexing can occur when the desired cut length in the web of material passing the cutoff roll 12 is changed. However, it should be noted that blade indexing can be performed at other times to more evenly distribute blade wear across the blades. For example, especially where cuts of the same length are to be made in a web of material for an extended period of time without equipment shutdown, blade indexing preferably occurs automatically (e.g., by an electronic controller) at regular time intervals or cutoff roll 12 rotations. Alternatively, blade indexing can be performed each time the parent rolls of web material fed into the system 10 are changed. Such blade indexing distributes blade wear and thereby increases operation time between required maintenance shutdowns.

As discussed above, a number of vacuum apertures 16 are preferably located between each pair of adjacent blades 18 on the cutoff roll 12. When suction is applied through these vacuum apertures 16 by opening corresponding vacuum lines 27 to a source of vacuum or a vacuum generator, that portion of the web of material beside the vacuum apertures 16 is held to the surface of the cutoff roll 12. Preferably, the portion of the web 22 is held to the roll before, during, and after the passing web 22 is cut by the blades 18 on either side of the web portion.

In the preferred embodiment of the present invention illustrated in the figures, one row of vacuum apertures 16 is centrally located between each pair of adjacent blades 18 on the cutoff roll 12, and is capable of holding (via suction) a web 22 lying across the vacuum apertures 16 during cutting operations by the adjacent blades 18. Because the twelve blades 18 on the cutoff roll 12 are equally spaced in the preferred embodiment shown, the rows of vacuum apertures 16 on the cutoff roll 12 are also equally spaced around the circumference of the cutoff roll 12, and are therefore separated from each other by approximately 30 degrees. In this configuration, one, two, three, four, six, or twelve equal cuts can be provided in the web 22 as the web 22 passes between the cutoff roll 12 and the cutoff bedroll 14 for each rotation of the cutoff roll 12. To produce each number of cuts, the same number of blades 18 must be spaced equally around the circumference of the cutoff roll 12 as follows: one blade produces one equally-spaced cut per cutoff roll rotation, two blades spaced 180 degrees apart produce two equally-spaced cuts per cutoff roll rotation, three blades spaced 120 degrees apart produce three equally-spaced cuts per cutoff roll rotation, four blades spaced 90 degrees apart produce four equally-spaced cuts per cutoff roll rotation, six blades spaced 60 degrees apart produce six equally-spaced cuts per cutoff roll rotation, and twelve blades spaced 30 degrees apart produce twelve equally-spaced cuts per cutoff roll rotation. Because systems 10 which can produce 3, 4, and 6 equally-spaced cuts per cutoff roll rotation are most desirable, a valve arrangement configured to produce vacuum only in these three blade configurations will be discussed by way of example only.

To provide vacuum to each portion of web 22 between adjacent cuts, at least one row of vacuum ports 16 is preferably activated (i.e., open to the vacuum source or vacuum generator) between each pair of extended blades 18. As noted above, although it is possible to activate all lines 27 in the cutoff roll 12 at once, such a practice is extremely inefficient and requires a relatively large vacuum source or generator. Selection of the rows of vacuum apertures 16 to which vacuum is to be supplied is performed by rotating the disks 32 and 34 described above to provide the proper vacuum configuration as will now be described with reference to FIGS. 7–9.

Figure 7:
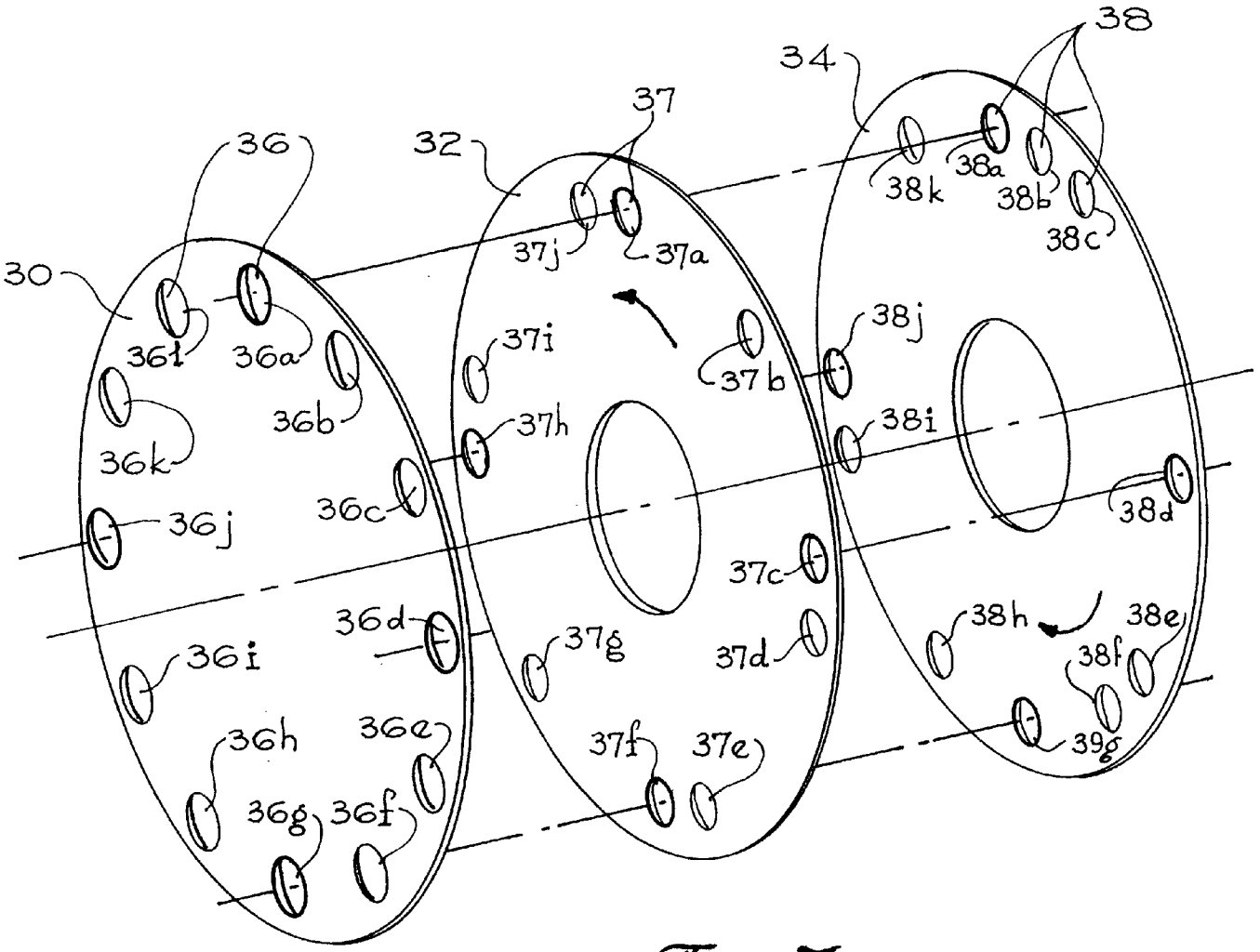
FIGS. 7–9 are perspective views of the vacuum valve disks in the preferred embodiment of the present invention shown in FIGS. 1–6, illustrating different alignments of the disks to provide a variety of vacuum configurations for the cutoff roll.
Figure 8:
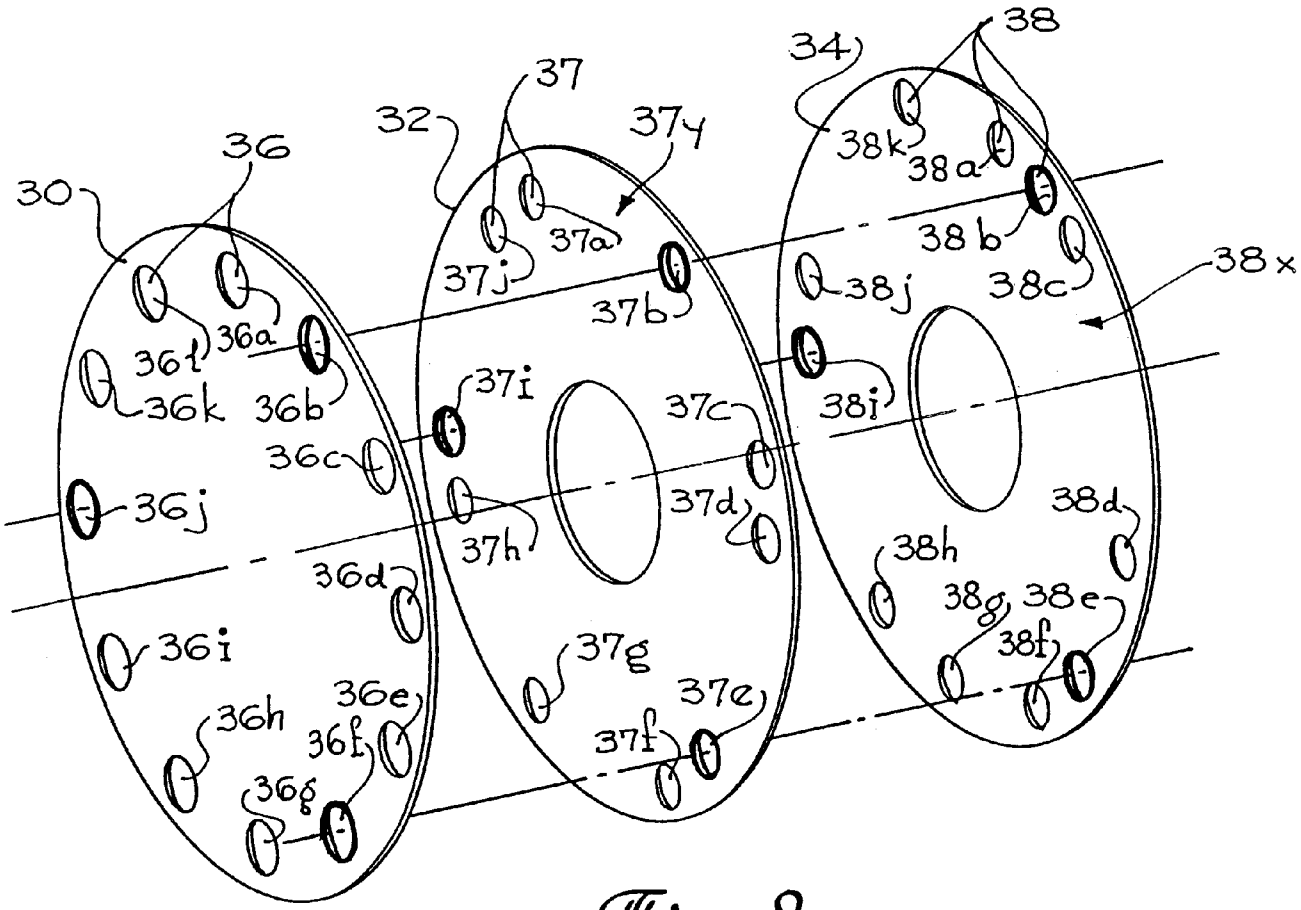
Figure 9:
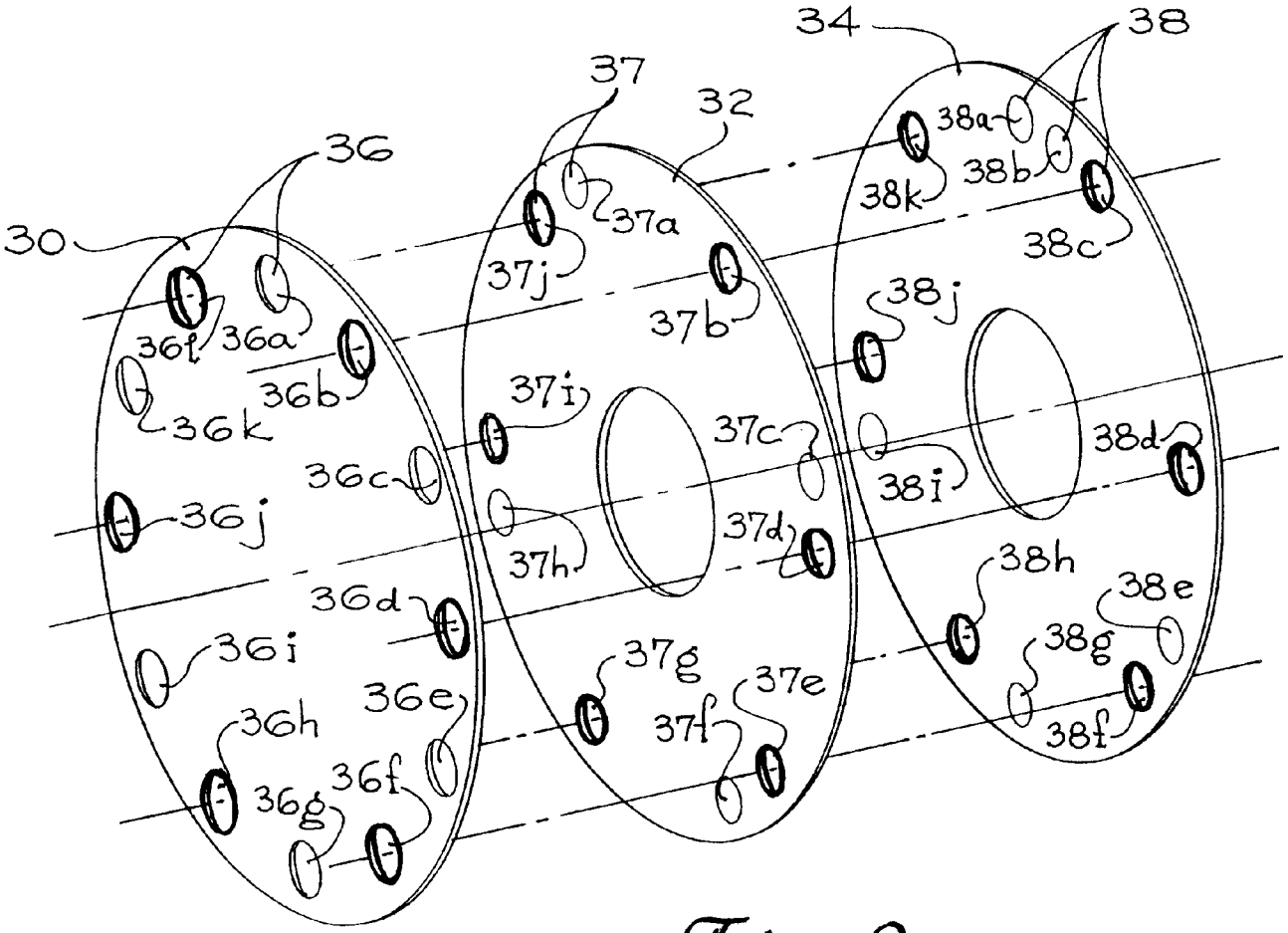

With continued reference to the preferred embodiment of the present invention illustrated in the drawings, and with particular reference to FIGS. 7–9, fixed disk 30 preferably includes twelve apertures 36*a*–36*l*, disk 32 includes ten apertures 37*a*–37*j* and disk 34 includes eleven apertures 38*a*–38*k*. FIG. 7 illustrates a set of disks 30, 32, 34 each having a set of apertures 36, 37, 38, respectively, which are arranged such that in a number of different relative positions with respect to one another, 3, 4, and 6 vacuum lines 27 are opened to the vacuum source or generator. It should be noted that the aperture arrangement shown in each of the disks 30, 32, 34 is only one of several aperture arrangements possible for each disk 30, 32, 34 which can be employed to achieve the same function just described. In the disk alignment illustrated in FIG. 7, disks 32 and 34 are rotationally adjusted so that apertures 37*a* and 38*a* are aligned with aperture 36*a* of disk 30, apertures 37*c* and 38*d* are aligned with aperture 36*d* of disk 30, apertures 37*f* and 38*g* are aligned with aperture 36*g* of disk 30, and apertures 37*h* and 38*j* are aligned with aperture 36*j* of disk 30. Note for example that aperture 36*b* overlies solid region 37*x* of disk 32, such that the supply of vacuum to the row of vacuum apertures 16 aligned with aperture 36*b* is blocked. With this configuration, vacuum will be supplied to only those vacuum inlets 16*a*, lines 27, and corresponding vacuum apertures 16 which are aligned with apertures 36*a*, 36*d*, 36*g*, and 36*j* of disk 30 (each of which are equally spaced 90 degrees apart).

FIG. 8 illustrates the alignment of the disks 30, 32 and 34 to provide vacuum to vacuum inlets 16*a*, vacuum lines 27, and corresponding vacuum apertures 16 for a configuration in which three cuts are made in the web 22 per cutoff roll rotation. In the disk alignment shown in FIG. 8, disks 32 and 34 are rotationally adjusted with disk 32 being rotated fifteen degrees counterclockwise and disk 34 being rotated fifteen degrees clockwise from the positions shown in FIG. 7. Consequently, apertures 37*b* and 38*b* are aligned with aperture 36*b* of disk 30, apertures 37*e* and 38*e* are aligned with aperture 36*f* of disk 30, and apertures 37*i* and 38*i* are aligned with aperture 36*j* of disk 30. By way of example, aperture 36*a* overlies solid region 37*y* of disk 32 so that the supply of vacuum to the row of vacuum apertures 16 aligned with aperture 36*a* is blocked. Also, although aperture 37*d* is aligned with aperture 36*d* in disk 30, the solid region 38*x* blocks the supply of vacuum to the row of vacuum apertures 16 aligned with aperture 36*d*.

FIG. 9 illustrates the alignment of the disks 30, 32 and 34 to provide vacuum to vacuum inlets 16*a*, vacuum lines 27, and corresponding vacuum apertures 16 for a configuration in which six cuts are made in the web 22 per cutoff roll rotation. In the disk alignment shown in FIG. 9, disks 32 and 34 are rotationally adjusted with the position of disk 32 being unchanged and the position of disk 34 being rotated fifteen degrees counterclockwise from its position in FIG. 8. Consequently, apertures 37*b* and 38*c* are aligned with aperture 36*b* of disk 30, apertures 37*d* and 38*d* are aligned with aperture 36*d* of disk 30, apertures 37*e* and 38*f* are aligned with aperture 36*f* of disk 30, apertures 37*g* and 38*h* are aligned with aperture 36*h* of disk 30, apertures 37*i* and 38*j* are aligned with aperture 36*j* of disk 30, and apertures 37*j* and 38*k* are aligned with aperture 36*l* of disk 30. Apertures 36*a*, 36*c*, 36*e*, 36*g*, 36*i* and 36*k* overlie solid portions of disk 32.

As can be seen in the figures illustrating one preferred embodiment of the present invention, the apertures 37*a*–37*j* of disk 32 and the apertures 38*a*–38*k* of disk 34 are each spaced apart around the axis of the disk 32, 34 by multiples of approximately 15 degrees. For example, aperture 37*j* is spaced approximately 15 degrees from aperture 37*a*, aperture 37*a* is spaced approximately 45 degrees from aperture 37*b*, aperture 37*b* is spaced approximately 45 degrees from aperture 37*c*, and aperture 37*c* is spaced approximately fifteen degrees from aperture 37*d*. Preferably also, the apertures 36*a*–36*l* of fixed disk 30 are spaced apart from each other by approximately 30 degrees. The fixed disk 30 is preferably dimensioned such that the separation between adjacent apertures 36 is greater than the circumference of the apertures 36. Therefore, when one of two adjacent apertures spaced fifteen degrees apart on one of the adjustable disks 32, 34 is aligned with an aperture in the fixed disk 30, the other aperture is positioned between adjacent apertures 36 on the fixed disk 30 and is therefore blocked to vacuum by the solid portion of the fixed disk 30 between the apertures 36.

By employing the arrangement of apertures 36, 37, 38 in the disks 30, 32, 34 as described above, the disks 32 and 34 can be rotationally adjusted relative to the fixed disk 30 to selectively connect vacuum to only a selected number of vacuum lines 27 and associated vacuum apertures 16 between extended blades 18 on the cutoff roll 12. When blades 18 are indexed on the cutoff roll 12, vacuum lines 27 can quickly be shut and others can be quickly opened to achieve a desired pattern of extended blades and vacuum aperture rows on the cutoff roll 12. The spacing of the apertures 36, 37, 38 on the disks 30, 32, 34 in the preferred angular increments described above insures that vacuum is supplied only to those vacuum lines 27 and associated vacuum apertures 16 which are needed, thereby increasing the efficiency of the system and permitting a smaller vacuum generator or vacuum source to be used.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the preferred embodiment of the present invention described above and illustrated in the figures has alternating longitudinally-oriented blades 18 and aperture rows. However, other systems employing the present invention can be significantly different, having actuatable elements (e.g., retractable blades, etc.) and vacuum or forced air apertures on any portion or portions of the rotating member surface and in any arrangement or pattern on the rotating member surface.

Also, the valves 26 of the present invention each preferably have three disks 30, 32, 34 as discussed above. However, it will be appreciated by one having ordinary skill in the art that one, two, four, or even more disks can instead be used to practice the present invention. (In a one-disk arrangement, the disk would be adjustable and would preferably rely upon the surface of the end 13 of the cutoff roll 12 in order to block those apertures in the disk which are not aligned with vacuum inlets 16*a* and associated vacuum lines 27 in the cutoff roll 12). Generally, more disks provide more aperture pattern possibilities through the disks to open vacuum to the vacuum inlets 16*a,* lines 27, and associated vacuum aperture rows. The number of possible aperture patterns will, of course, also depend directly upon the number and size of apertures in the disks, the number and size of vacuum inlets 16*a* and associated vacuum lines 27 in the roll 12, and the spacings between adjacent apertures in the disks and between adjacent vacuum inlets 16*a* in the cutoff roll 12.

I claim:

1. A method of cutting a continuous web of material into sheets of varying lengths using a vacuum assisted roll, the method comprising the steps of:

selectively extending a first blade located upon the roll to define a first blade configuration on the roll;

holding the web against a surface of the roll via suction by applying vacuum through at least one vacuum aperture in the roll;

creating regularly-spaced cuts in the web by the blade;

retracting the blade;

extending a second blade located upon the roll to define a second blade configuration on the roll, the second blade located a distance from the first blade; and holding the web against another surface of the roll via suction by changing application of vacuum from the at least one vacuum aperture to at least one different vacuum aperture on the roll.

2. The method as claimed in claim 1, wherein at least two blades are extended in at least one of the first and second blade configurations.

3. The method as claimed in claim 2, wherein multiple extended blades in the first and second blade configurations are equally spaced with respect to one another on the roll.

4. The method as claimed in claim 3, wherein the extended blades in the first and second blade configurations are equal in number.

5. The method as claimed in 2, wherein multiple blades are extended in the first and second blade configurations and wherein the blades extended in the first configuration are each spaced in a common direction and a common distance on the roll from the blades extended in the second configuration.

6. The method as defined in claim 2, further including the step of indexing the blades between blade configurations such that blades being extended in the second blade configuration are directly adjacent blades being retracted from the first blade configuration.

7. The method as claimed in claim 3, wherein the extended blades in the first and second blade configurations are different in number.

8. The method as claimed in claim 1, wherein the step of changing application of vacuum includes movement of at least one apertured disk coupled to the roll.

9. The method as claimed in claim 8, wherein changing application of vacuum includes rotation of the at least one apertured disk with respect to the roll.

10. The method as claimed in claim 9, wherein in the step of changing application of vacuum, one or more vacuum inlets in the roll are blocked by the at least one apertured disk from fluid communication with a vacuum source; and one or more vacuum inlets in the roll are opened to fluid communication with the vacuum source by being aligned with apertures in the at least one apertured disk.

11. The method as claimed in claim 1, wherein the steps of retracting the first blade, extending the second blade, and changing the application of vacuum are performed substantially simultaneously.

12. The method as claimed in claim 1, wherein the at least one vacuum aperture is located beside the first blade and wherein the at least one different vacuum aperture is located beside the second blade.

13. The method as defined in claim 1, wherein in the step of creating regularly-spaced cuts in the web, the web is cut into separate sheets.

14. The method as defined in claim 1, wherein in the step of creating regularly-spaced cuts in the web, perforations are created between sheets in the web.

* * * * *